US008556786B2

(12) United States Patent
Chen

(10) Patent No.: US 8,556,786 B2
(45) Date of Patent: Oct. 15, 2013

(54) THIGH EXERCISER

(76) Inventor: Chun Hu Chen, Chang Hua (TW)

( * ) Notice: Subject to any disclaimer, the term of this patent is extended or adjusted under 35 U.S.C. 154(b) by 216 days.

(21) Appl. No.: 13/068,443

(22) Filed: May 11, 2011

(65) Prior Publication Data

US 2012/0178600 A1 Jul. 12, 2012

(30) Foreign Application Priority Data

Jan. 12, 2011 (TW) ..... 100200659 U

(51) Int. Cl.
*A63B 21/05* (2006.01)
*A63B 21/02* (2006.01)

(52) U.S. Cl.
USPC ..... 482/128; 482/122; 482/124

(58) Field of Classification Search
USPC ..... 482/121–122, 124, 126, 128, 139, 908
See application file for complete search history.

(56) References Cited

U.S. PATENT DOCUMENTS

D341,401 S 11/1993 Reichman
5,267,929 A * 12/1993 Chen ..... 482/128
5,674,164 A * 10/1997 Kravitz ..... 482/126
5,980,436 A 11/1999 Cheng

* cited by examiner

*Primary Examiner* — Loan Thanh
*Assistant Examiner* — Jennifer M Deichl
(74) *Attorney, Agent, or Firm* — Charles E. Baxley

(57) ABSTRACT

A thigh exerciser includes a U-shaped frame having a space formed between two levers, a retaining member coupled between the levers for connecting and retaining the levers of the frame together, and a spring biasing member having two arms engaged with the levers and secured to the levers respectively for securing the spring biasing member to the levers of the frame. The frame includes a projection extended from each of the levers for engaging with the arms and for securing the arms of the spring biasing member to the levers of the frame. The spring biasing member includes a channel formed in each of the arms for slidably and adjustably engaging with the projection of the lever.

5 Claims, 13 Drawing Sheets

THIGH EXERCISER

BACKGROUND OF THE INVENTION

1. Field of the Invention

The present invention relates to a thigh exerciser, and more particularly to a thigh exerciser including a retaining member disposed or attached or mounted or coupled between the two arms of the spring biasing member for suitably coupling and retaining the two arms of the spring biasing member together, and including a spring biasing member adjustable to different strengths for allowing the users of different strengths or of different ages to suitably operate the thigh exerciser, and including a shield for suitably shielding or blocking the space between the two arms of the spring biasing member or between the supporters and for preventing the perineum portion of the user from being clamped between the two arms of the spring biasing member or between the supporters inadvertently.

2. Description of the Prior Art

Typical thigh exercisers comprise two curved supporters for engaging with the thigh portion or for engaging with the inner portions of the legs of the user, and a spring biasing member disposed or engaged between the curved supporters for providing a spring biasing force between the curved supporters and for allowing the user to force the curved supporters toward each other and to exercise and train the muscle groups of the thigh portion or the legs of the user.

For example, U.S. Design Pat. No. Des. 341,401 to Reichman, and U.S. Pat. No. 5,980,436 to Cheng disclose two of the typical thigh exercisers each also comprising a spring biasing member disposed or engaged between two supporters and arranged for allowing the supporters to be forced and moved toward each other by the legs of the user and to be forced and biased and moved away from each other by the spring biasing member, and for exercising the legs of the user.

However, the space or the compartment between the two arms of the spring biasing member or between the curved supporters has not been shielded or blocked such that the perineum portion of the user may have a good chance to be clamped or clipped between the two arms of the spring biasing member or between the curved supporters inadvertently.

In addition, the spring biasing force of the spring biasing member applied to the supporters may not be adjusted according to the users of different strengths or of different ages and may not be operated by the users of different strengths or ages.

The present invention has arisen to mitigate and/or obviate the afore-described disadvantages of the conventional thigh or leg exercisers.

SUMMARY OF THE INVENTION

The primary objective of the present invention is to provide a thigh exerciser including a retaining member disposed or attached or mounted or coupled between the two arms of the spring biasing member for suitably coupling and retaining the two arms of the spring biasing member together.

The other objective of the present invention is to provide a thigh exerciser including a spring biasing member adjustable to different strengths for allowing the users of different strengths or of different ages to suitably operate the thigh exerciser.

The further objective of the present invention is to provide a thigh exerciser including a shield for suitably shielding or blocking the space between the two arms of the spring biasing member or between the supporters and for preventing the perineum portion of the user from being clamped between the two arms of the spring biasing member or between the supporters inadvertently.

In accordance with one aspect of the invention, there is provided a thigh exerciser comprising a U-shaped frame including two levers, and a space formed between the levers, a retaining member coupled between the levers for connecting and retaining the levers of the frame together, and a spring biasing member including two arms engaged with the levers and secured to the levers respectively for securing the spring biasing member to the levers of the frame.

The frame includes a projection extended from each of the levers for engaging with the arms and for securing the arms of the spring biasing member to the levers of the frame. The spring biasing member includes a channel formed in each of the arms for slidably receiving and for adjustably engaging with the projection of the lever respectively.

The spring biasing member includes a first notch formed therein and communicative with one of the channels for selectively engaging with the projection of the lever. The spring biasing member includes at least one second notch formed therein and communicative with one of the channels for selectively engaging with the projection of the lever.

In accordance with the other aspect of the invention, there is provided a thigh exerciser comprising a U-shaped frame including two levers, and a space formed between the levers, a spring biasing member including two arms engaged with the levers and secured to the levers respectively for securing the spring biasing member to the levers of the frame and for providing or applying a spring biasing forces between the levers, and a shield attached to the frame for shielding the space between the levers of the frame and for preventing a perineum portion of a user from being clamped between the levers of the frame inadvertently.

The shield includes an engaging member extended outwardly therefrom for engaging with the frame and for anchoring and retaining the shield to the frame. The frame includes a pair of tracks provided on the levers respectively for engaging with the engaging member of the shield and for anchoring and retaining the shield to the frame.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
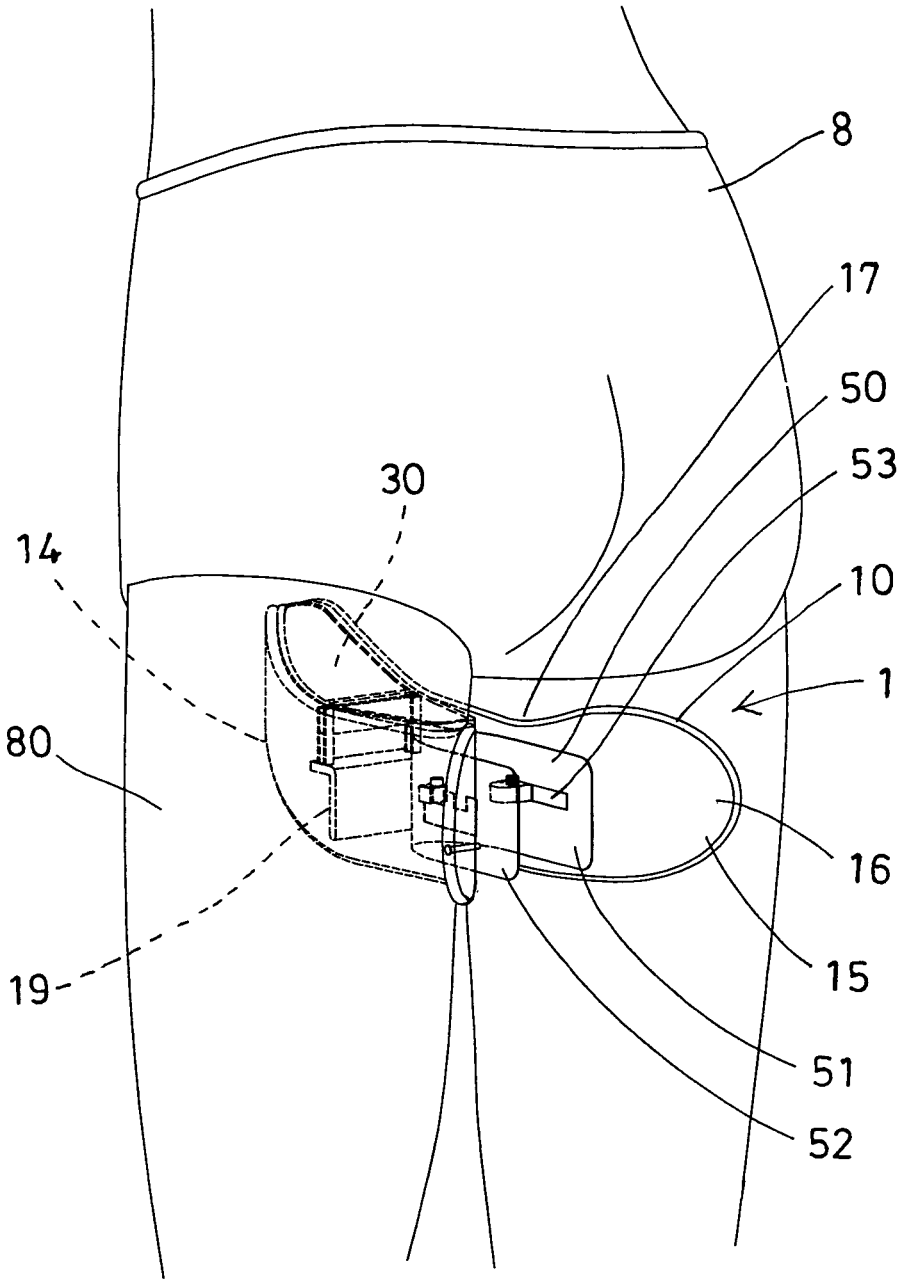
FIG. 1 is a perspective view of a thigh exerciser in accordance with the present invention, illustrating the attachment of the thigh exerciser to the thigh portion or the upper leg portion or the perineum portion of the user.
Figure 2:
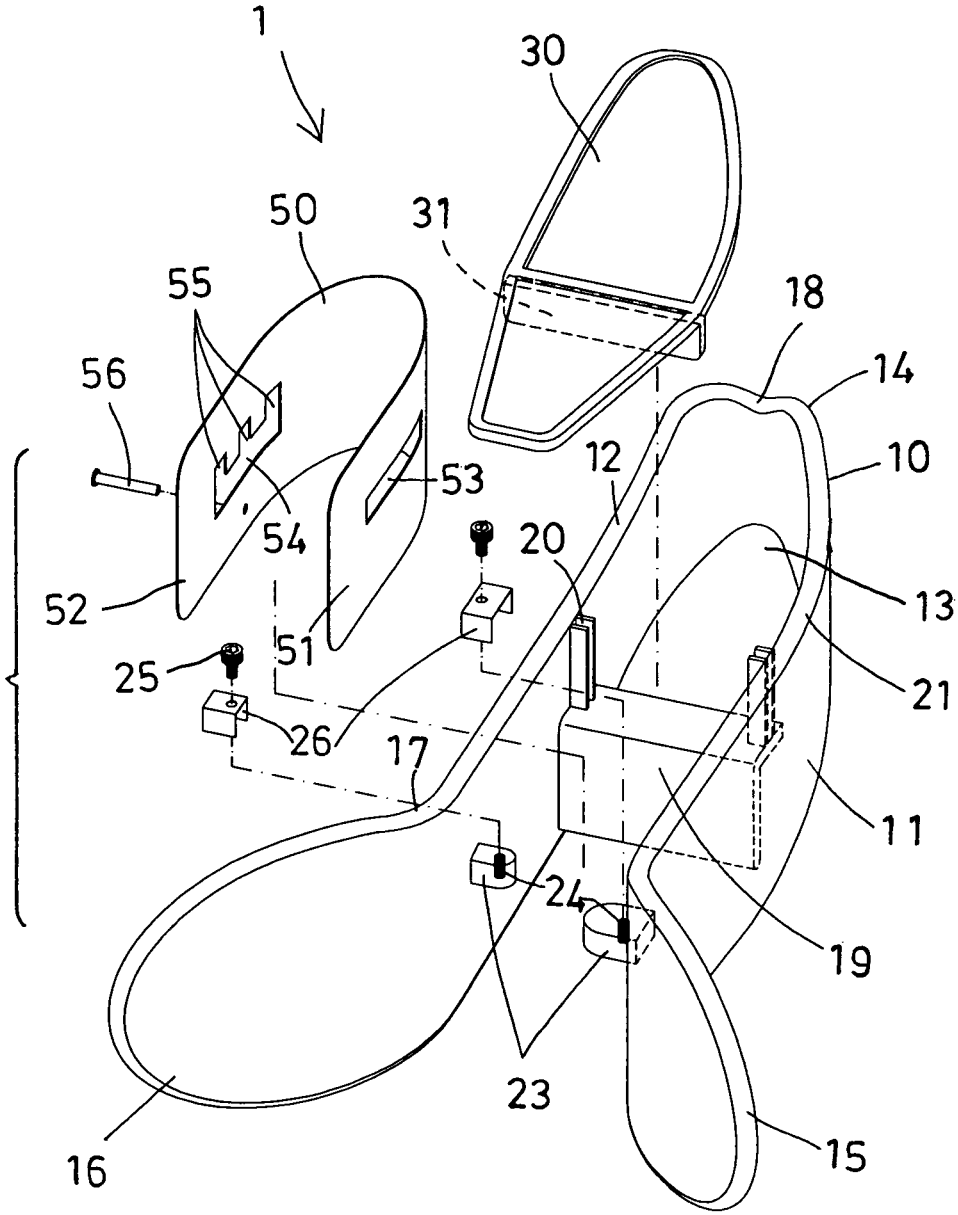
FIG. 2 is an exploded view of the thigh exerciser.
Figure 3:
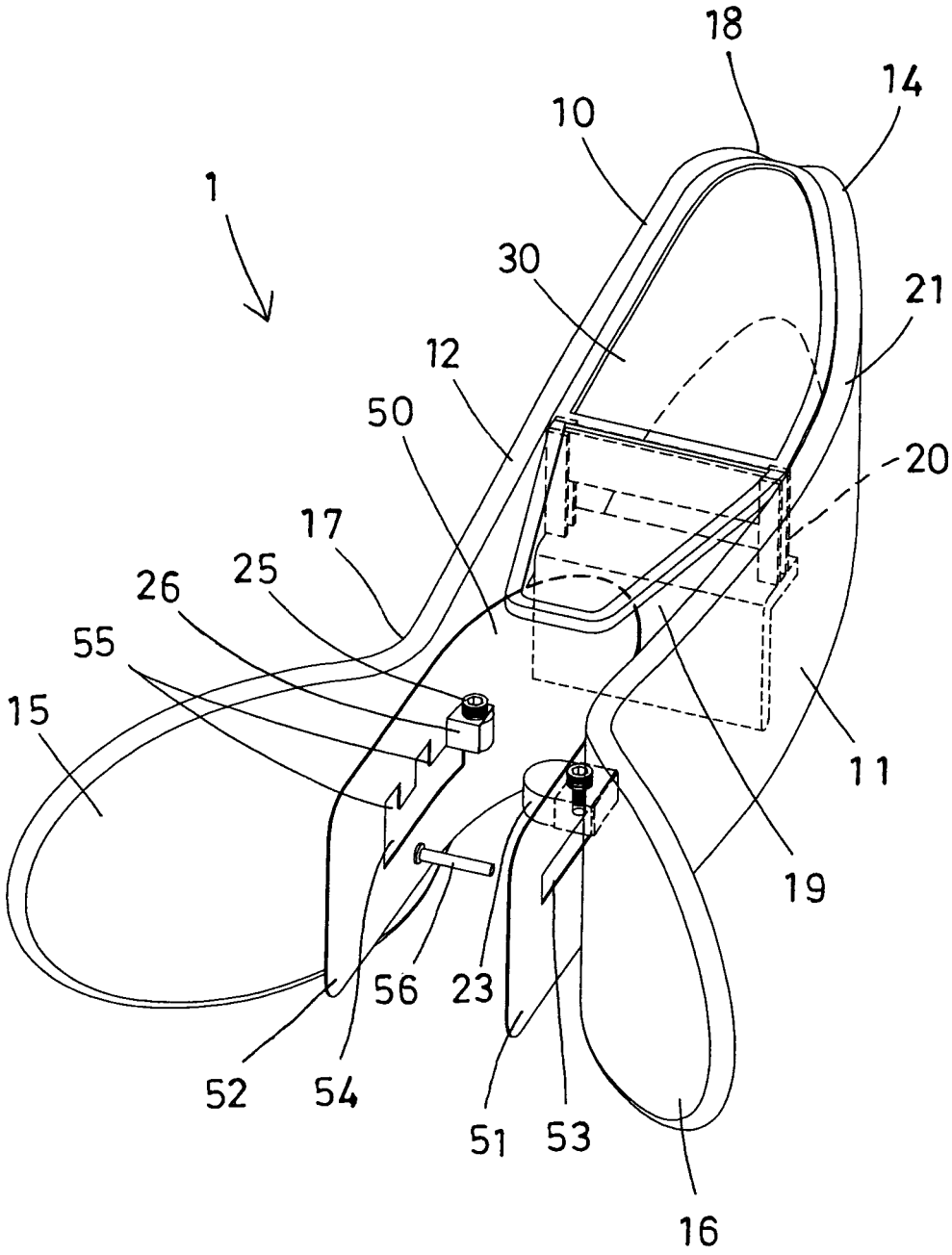
FIG. 3 is a perspective view of the thigh exerciser.
Figure 4:
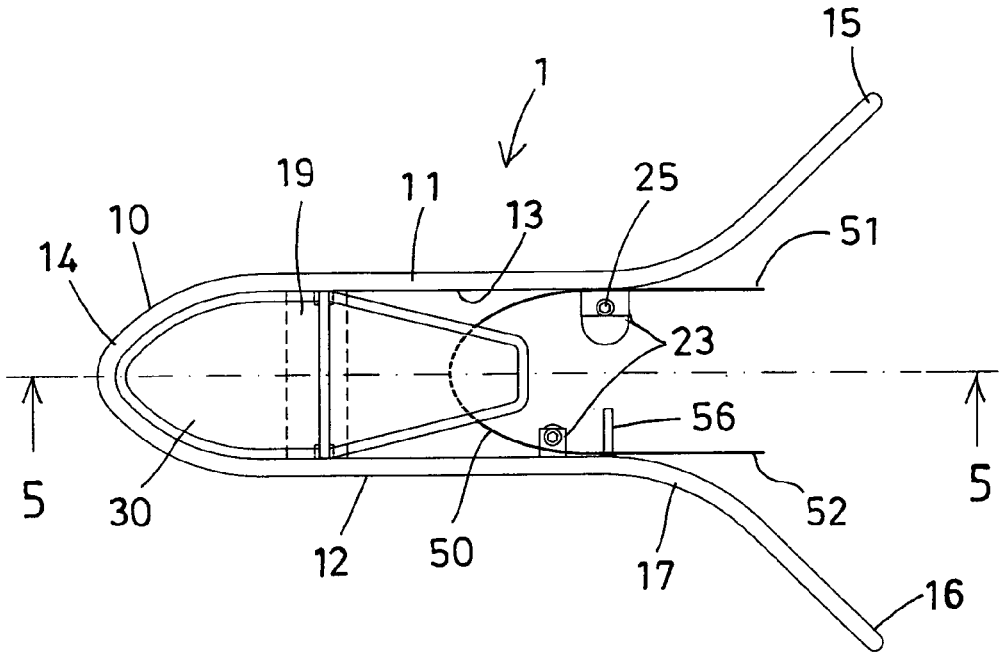
FIG. 4 is an upper plan schematic view of the thigh exerciser.
Figure 5:
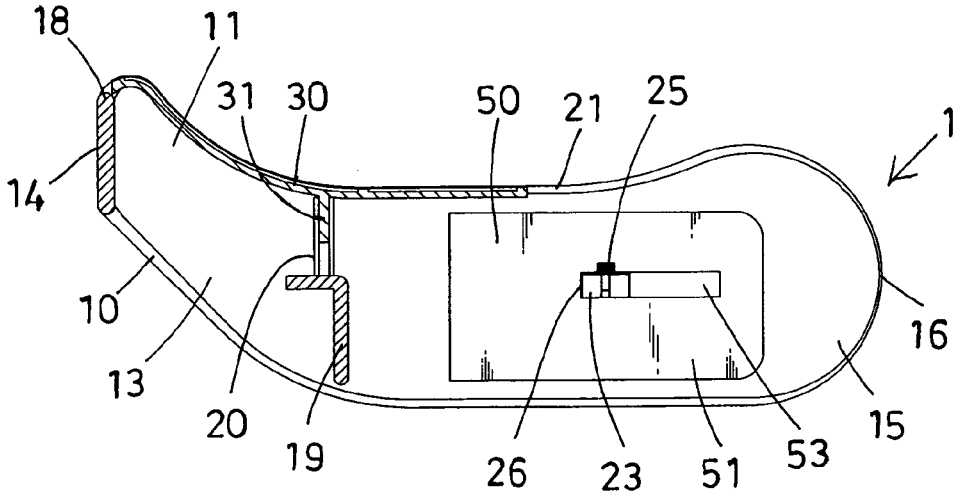
FIG. 5 is a cross sectional view of the thigh exerciser, taken along lines 5-5 of FIG. 4.
Figure 6:
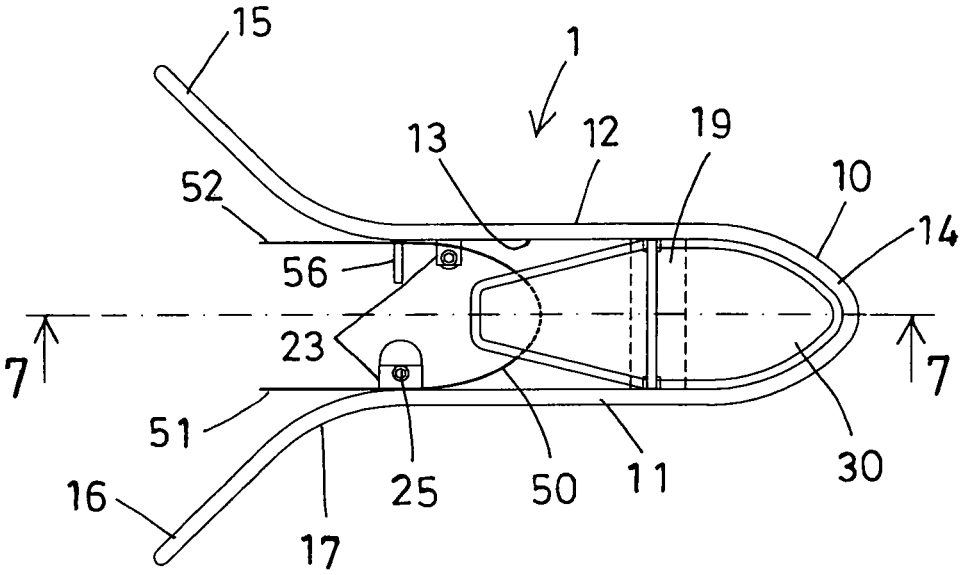
FIG. 6 is another upper plan schematic view of the thigh exerciser which is arranged in the different direction as that shown in FIG. 4.
Figure 7:
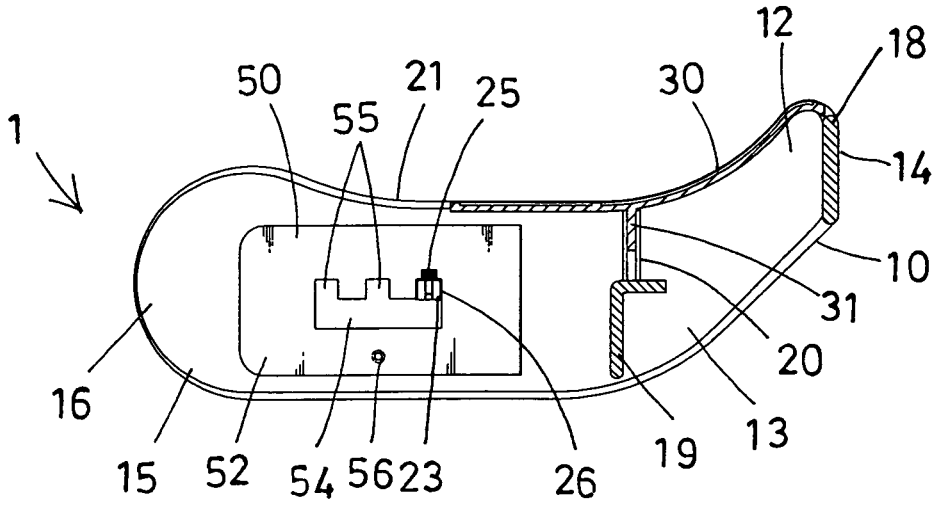
FIG. 7 is a cross sectional view of the thigh exerciser, taken along lines 7-7 of FIG. 6.

Referring to the drawings, and initially to FIGS. 1-7, a thigh exerciser 1 in accordance with the present invention is arranged and provided to be disposed or engaged into the thigh portion or the perineum portion of the user 8 and to be engaged between the upper leg portions 80 of the user 8 (FIGS. 1, 12, 14, 20), and arranged to be actuated or operated by the leg portions 80 of the user 8 in order to exercise and train the muscle groups of the thigh portion or the legs of the user. The thigh exerciser 1 comprises a U-shaped body or housing or frame 10 including two panels or levers 11, 12 having a space 13 formed or defined between the levers 11, 12, and including one end portion 14 folded and connected together, and including a flap 15 formed or provided on the other end portion 16 of each of the levers 11, 12.

As best shown in FIGS. 1, 4, 6, 12, and 14, the flaps 15 are outwardly and smoothly folded or curved away from each other for forming a curved engaging portion 17 in each of the levers 11, 12 and for suitably and comfortably engaging with the thigh portion or the perineum portion or the upper leg portions 80 of the user 8, and for allowing the levers 11, 12 to be forced and moved toward each other by the leg portions 80 of the user 8. It is preferable that the frame 10 includes a curved recess or depression 18 formed or provided on the one end portion 14 thereof for forming a hand grip portion and for being smoothly and comfortably grasped or held by the user. A coupling or connecting or retaining member 19 is provided and attached or mounted or secured or coupled between the middle portions of the levers 11, 12 for suitably coupling or connecting the levers 11, 12 together.

As best shown in FIGS. 4-7, the connecting or retaining member 19 is provided and disposed or located closer to the one end portion 14 of the frame 10 and arranged for allowing the flaps 15 or the other end portions 16 of the levers 11, 12 to be suitably forced and moved toward each other by the leg portions 80 of the user 8. The frame 10 further includes a pair of tracks 20 formed or provided or attached or mounted or secured to the connecting or retaining member 19 and/or attached or mounted or secured to the levers 11, 12 respectively. A cover or shield 30 is attached or mounted or secured to the upper portion 21 of the frame 10 for suitably shielding or blocking the space 13 between the two levers 11, 12 of the frame 10 and for preventing the perineum portion of the user from being clamped between the levers 11, 12 of the frame 10 inadvertently.

For example, the shield 30 includes an insert or engaging member 31 extended downwardly therefrom for engaging with the tracks 20 of the frame 10 and for attaching or mounting or securing or anchoring or retaining the shield 30 to the upper portion 21 of the frame 10 and for shielding or blocking the space 13 between the two levers 11, 12 of the frame 10 and for preventing the perineum portion of the user from being clamped between the levers 11, 12 of the frame 10 inadvertently. The frame 10 further includes a key or projection 23 extended from each of the levers 11, 12 and disposed or located closer to the other end portion 16 of the frame 10, and includes a screw hole 24 formed in each of the projections 23 for threading or engaging with a fastener 25.

Figure 8:
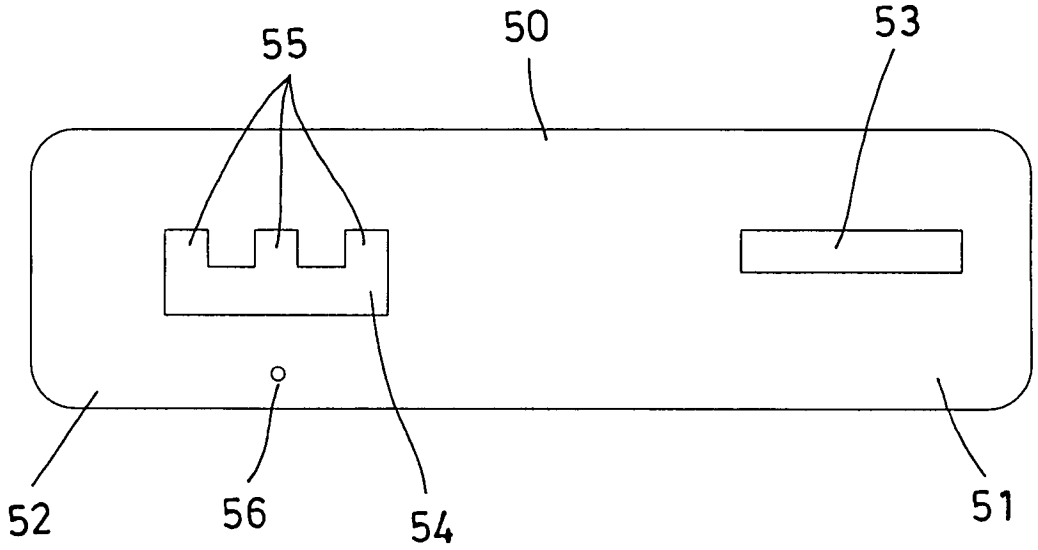
FIG. 8 is a plan schematic view of a spring biasing member for the thigh exerciser.
Figure 9:
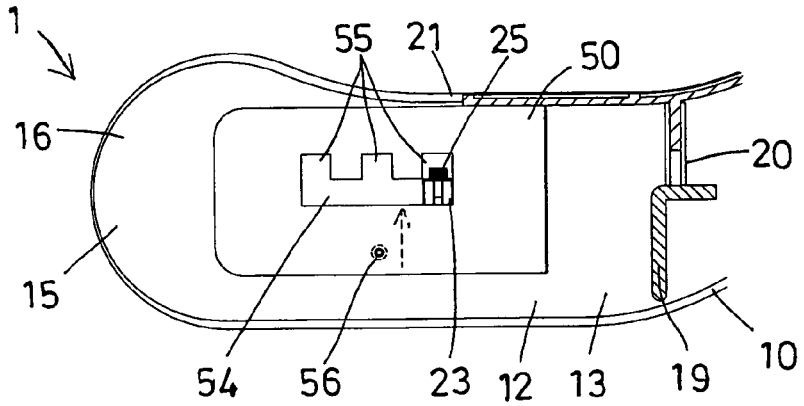
FIGS. 9, 10, 11 are partial cross sectional views similar to FIG. 7, illustrating the operation of the thigh exerciser.
Figure 10:
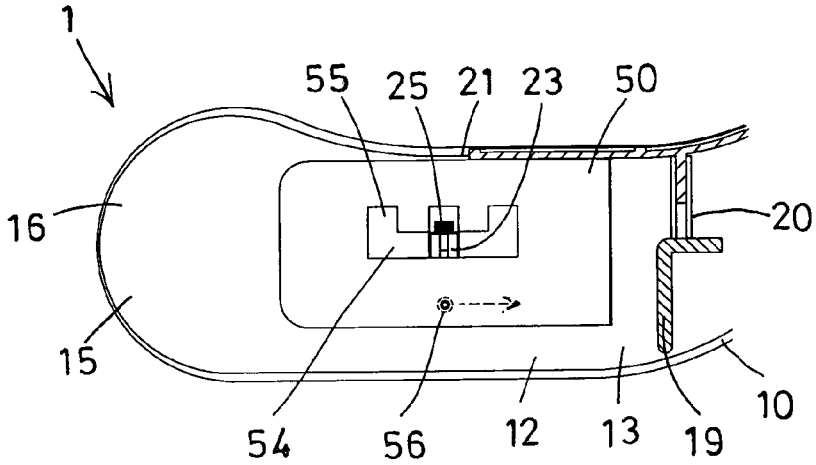
Figure 11:
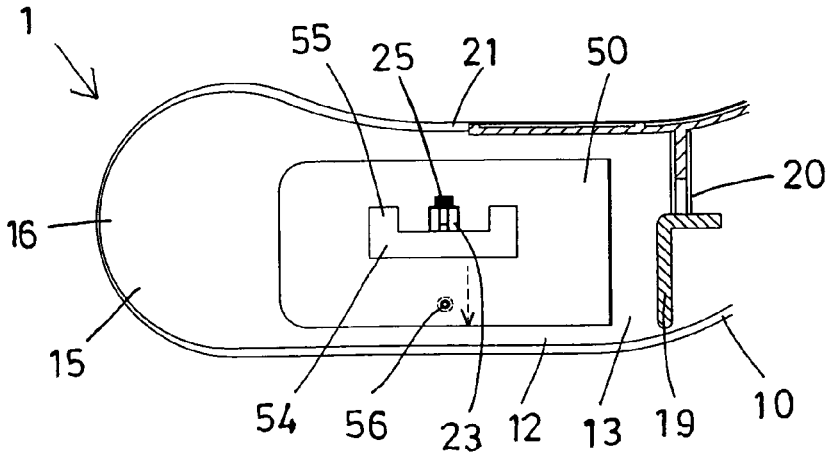

A U-shaped spring biasing member 50 is further provided and includes two arms 51, 52 for engaging with the levers 11, 12 respectively. For example, the arms 51, 52 each include a channel 53, 54 formed therein for slidably receiving or engaging with the projections 23 of the levers 11, 12 respectively and for adjustably attaching or mounting or securing the spring biasing member 50 to the levers 11, 12 and for providing or applying different or adjustable spring biasing forces between the levers 11, 12. For example, the spring biasing member 50 includes one or more (such as three) notches 55 formed in one of the arms 52 (FIG. 8) and intersecting or communicative with the channel 54 thereof for selectively and for adjustably engaging with the projection 23 of the lever 12 and for adjustably attaching or mounting or securing the spring biasing member 50 to the lever 12 at different locations or positions.

The fasteners 25 may be used to mount or secure or anchor or retain the spring biasing member 50 to the levers 11, 12 of the frame 10 directly; or, a latch 26 may further be provided and attached or mounted or secured to each of the projections 23 for engaging with the spring biasing member 50 and for further solidly and stably mounting or securing or anchoring or retaining the spring biasing member 50 to the levers 11, 12 of the frame 10 (FIGS. 2-3, 5, 7). As shown in FIGS. 9-15, the projection 23 and/or the latch 26 may be moved or adjusted to engage with either of the notches 55 of the arm 52 and to adjustably attach or mount or secure the spring biasing member 50 to the lever 12 at different locations or positions and thus for providing different or adjustable spring biasing forces between the levers 11, 12. A hand grip or knob 56 may be attached to either of the arms 51, 52 of the spring biasing member 50 for moving the spring biasing member 50 relative to the levers 11, 12 of the frame 10.

Figure 12:
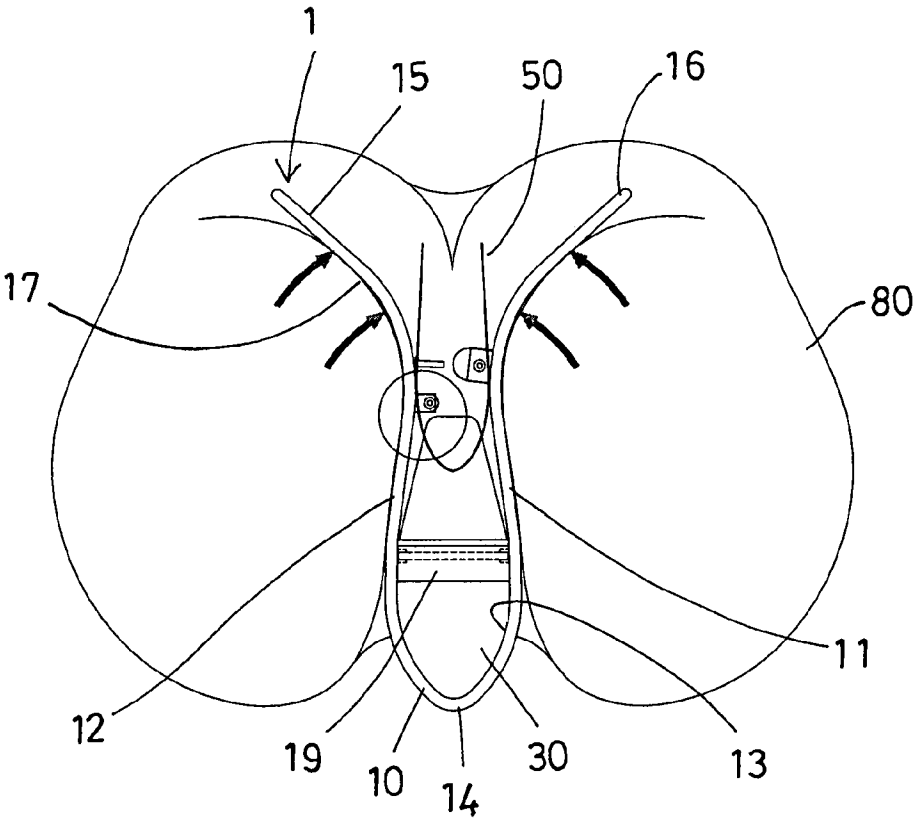
FIGS. 12, 14 are bottom plan schematic views illustrating the operation of the thigh exerciser.
Figure 13:
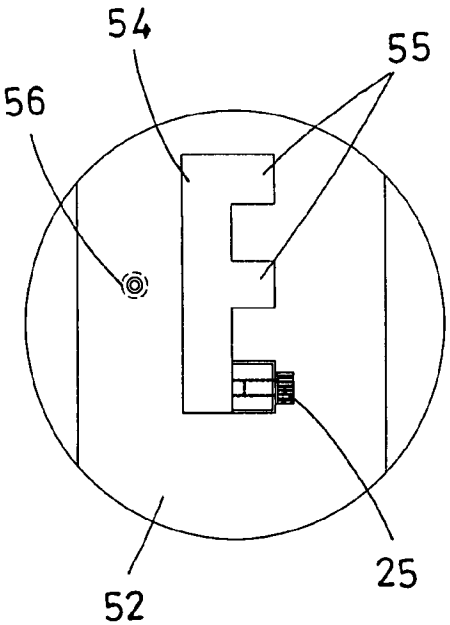
FIGS. 13, 15 are partial plan schematic views of the thigh exerciser as shown in FIGS. 12, 14 respectively.
Figure 14:
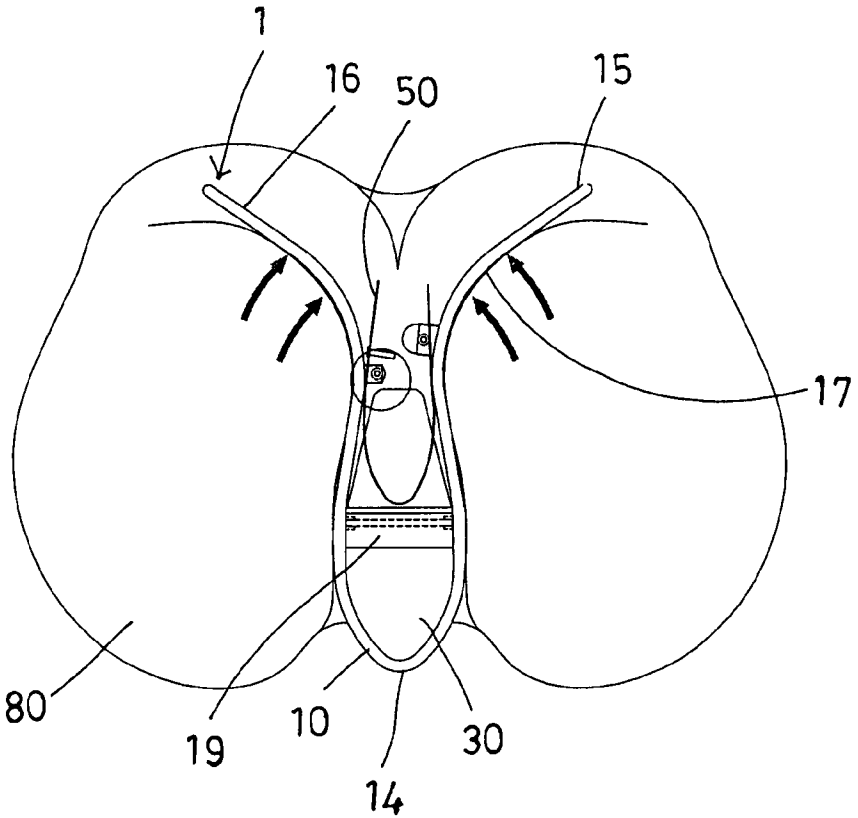
Figure 15:
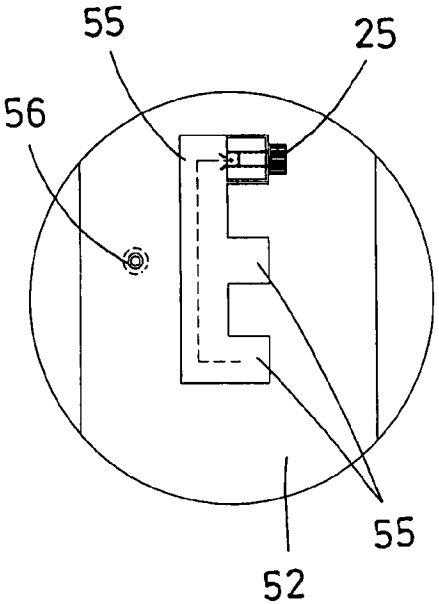
Figure 16:
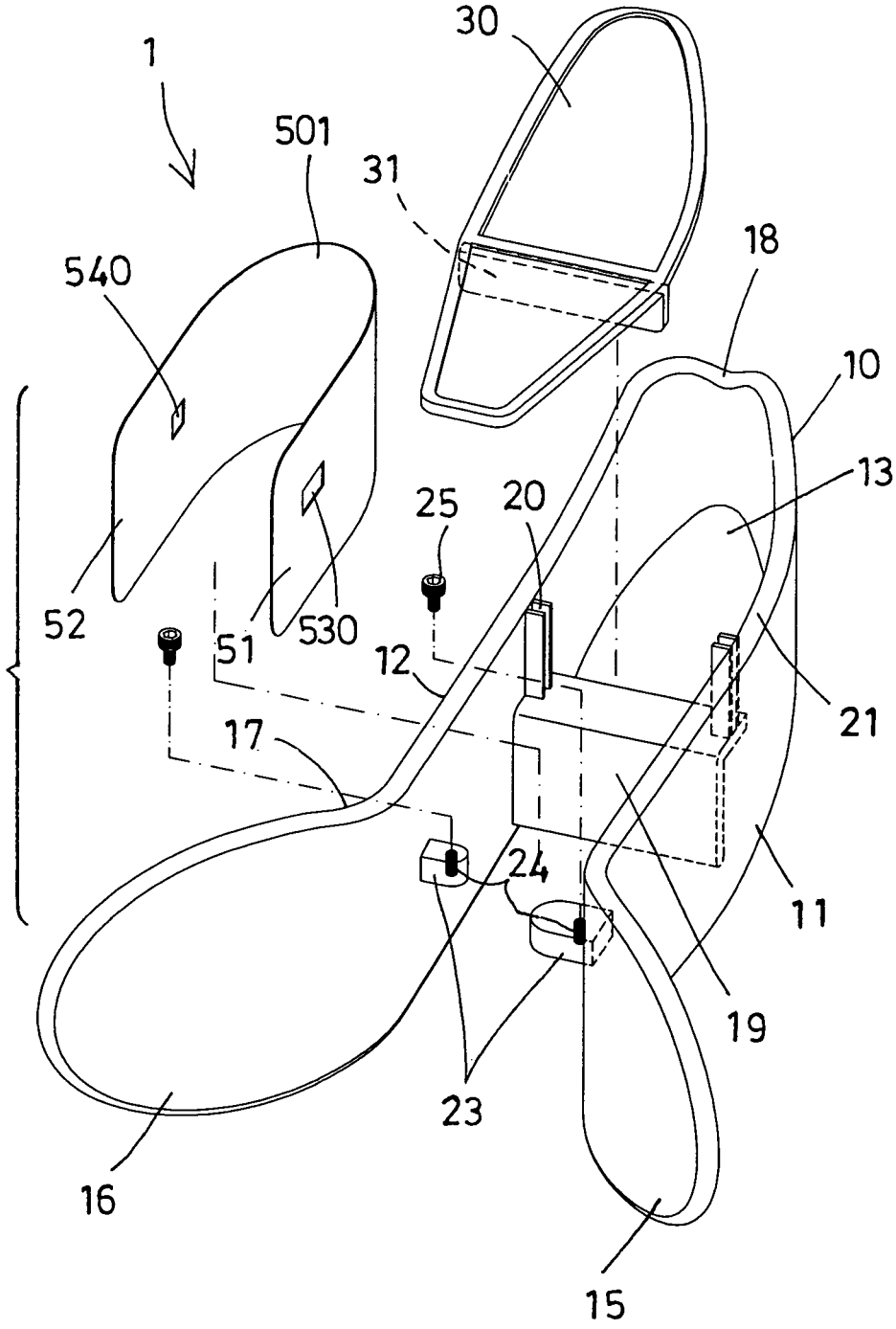
FIG. 16 is an exploded view similar to FIG. 2, illustrating the other arrangement of the thigh exerciser.
Figure 17:
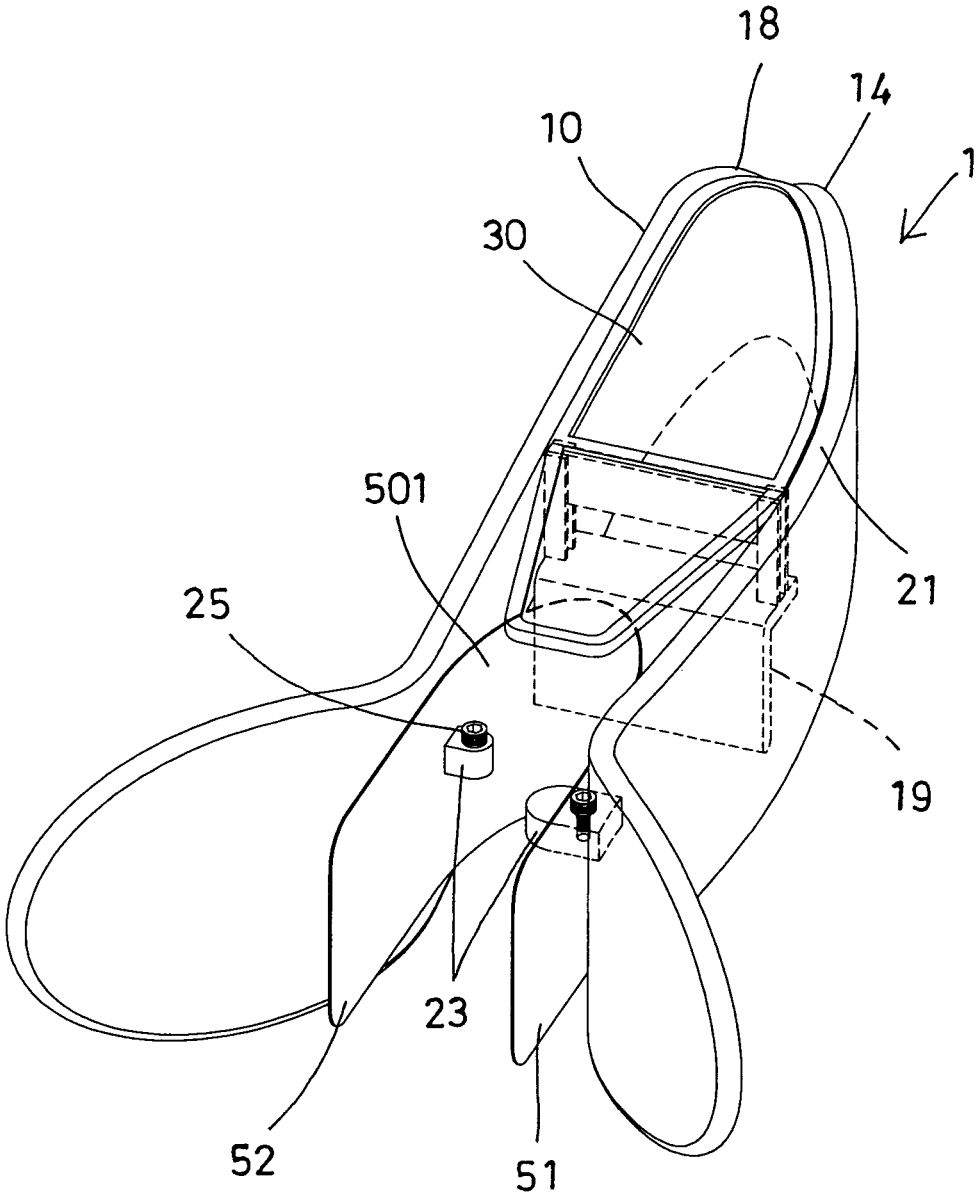
FIG. 17 is a perspective view of the thigh exerciser as shown in FIG. 16.
Figure 18:
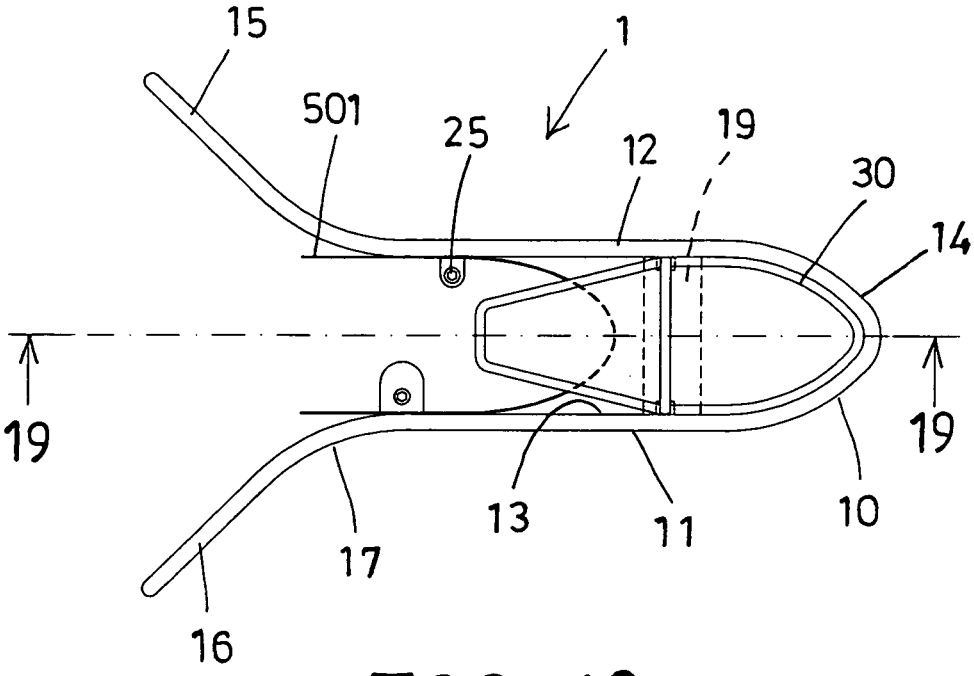
FIG. 18 is an upper plan schematic view of the thigh exerciser as shown in FIGS. 16, 17.
Figure 19:
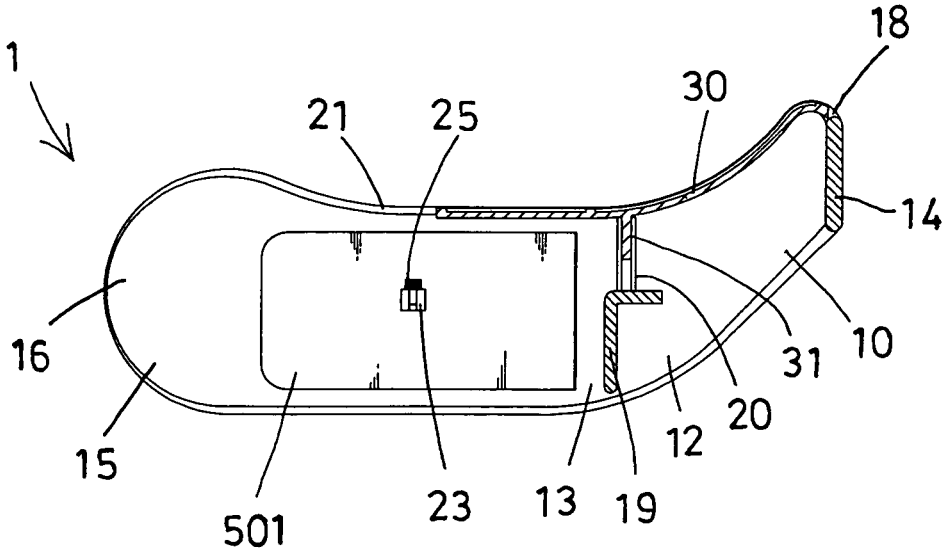
FIG. 19 is a cross sectional view of the thigh exerciser, taken along lines 19-19 of FIG. 18.
Figure 20:
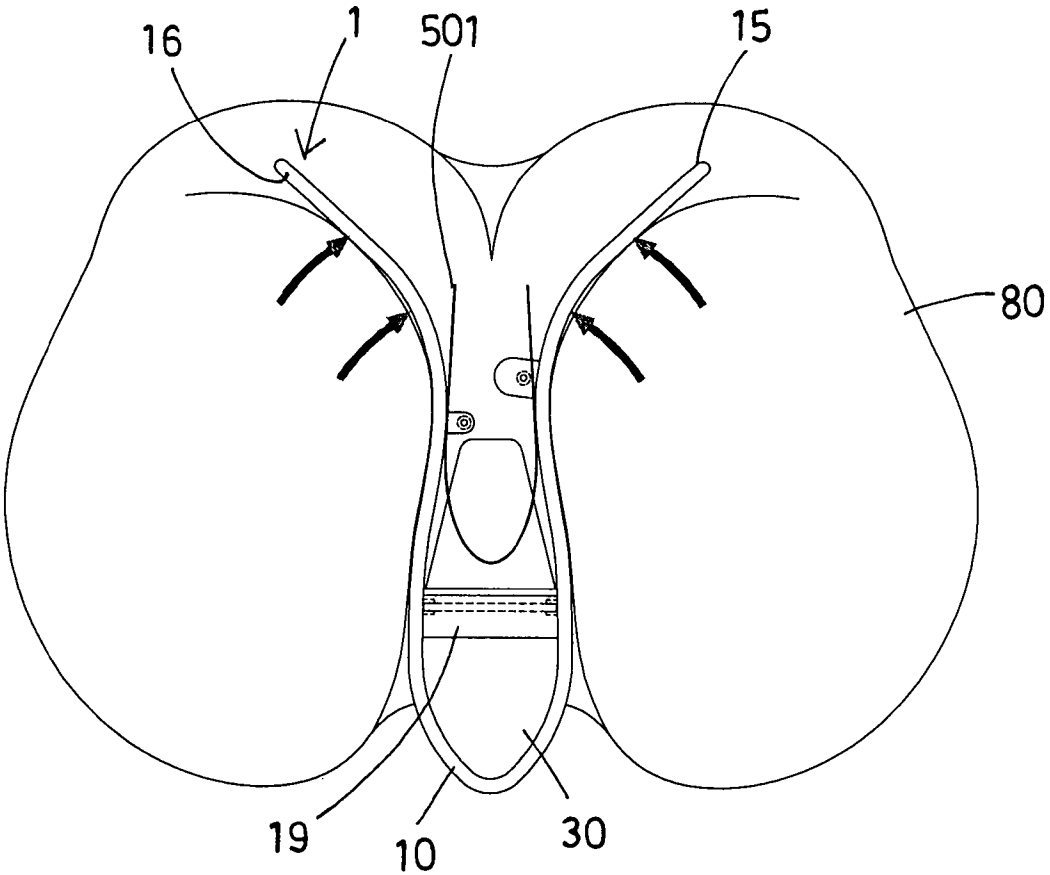
FIG. 20 is a bottom plan schematic view illustrating the operation of the thigh exerciser as shown in FIGS. 16-19.

In operation, as shown in FIGS. 12-13, when the projection 23 at the lever 12 is moved or adjusted to engage with one of the notches 55 of the arm 52 and to adjustably attach or mount or secure the spring biasing member 50 to the lever 12 at a location or position farther away from the connecting or retaining member 19 or the one end portion 14 of the frame 10, the user 8 may have to spend a relatively greater force to force or move the levers 11, 12 toward each other with the leg portions 80 of the user 8. On the contrary, as shown in FIGS. 14-15, when the projection 23 at the lever 12 is moved or adjusted to engage with the other notches 55 of the arm 52 and to adjustably attach or mount or secure the spring biasing member 50 to the lever 12 at a location or position closer to the connecting or retaining member 19 or the one end portion 14 of the frame 10, the user 8 may have to spend a relatively smaller force to force or move the levers 11, 12 toward each other with the leg portions 80 of the user 8.

Alternatively, as shown in FIGS. 16-20, the spring biasing member 501 may include an orifice or aperture 530, 540 formed in each of the arms 51, 52 of the spring biasing member 501 for slidably receiving or engaging with the projections 23 of the levers 11, 12 respectively and for solidly and stably attaching or mounting or securing the spring biasing member 501 to the levers 11, 12 of the frame 10.

Accordingly, the thigh exerciser in accordance with the present invention includes a retaining member disposed or attached or mounted or coupled between the two arms of the spring biasing member for suitably coupling and retaining the two arms of the spring biasing member together, and including a spring biasing member adjustable to different strengths for allowing the users of different strengths or of different ages to suitably operate the thigh exerciser, and including a shield for suitably shielding or blocking the space between the two arms of the spring biasing member or between the supporters and for preventing the perineum portion of the user from being clamped between the two arms of the spring biasing member or between the supporters inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A thigh exerciser comprising:

a U-shaped frame including two levers, and a space formed between said levers, said frame including a projection extended from each of said levers, a retaining member coupled between said levers for connecting and retaining said levers of said frame together, and a spring biasing member including two arms engaged with said levers and secured to said levers respectively for securing said spring biasing member to said levers of said frame, said spring biasing member including a channel formed in each of said arms for receiving and engaging with said projection of said lever respectively, and including a first notch formed therein and communicative with one of said channels for selectively engaging with said projection of said lever.

2. The thigh exerciser as claimed in claim 1, wherein said spring biasing member includes at least one second notch formed therein and communicative with one of said channels for selectively engaging with said projection of said lever.

3. A thigh exerciser comprising:

a U-shaped frame including two levers, and a space formed between said levers, and including a projection extended from each of said levers, a spring biasing member including two arms adjustably secured to said levers respectively for securing said spring biasing member to said levers of said frame at different locations and for providing different spring biasing forces between said levers, said spring biasing member including a channel formed in each of said arms for slidably receiving and engaging with said projection of said lever respectively, and including a first notch formed therein and communicative with one of said channels for selectively engaging with said projection of said lever.

4. The thigh exerciser as claimed in claim 3, wherein said spring biasing member includes at least one second notch formed therein and communicative with one of said channels for selectively engaging with said projection of said lever.

5. The thigh exerciser as claimed in claim 3, wherein said frame includes a retaining member coupled between said levers for connecting and retaining said levers of said frame together.

* * * * *